United States Patent [19]

Varghese

[11] Patent Number: 4,581,127

[45] Date of Patent: Apr. 8, 1986

[54] METHOD TO DECREASE THE AGING RATE OF PETROLEUM OR LUBE PROCESSING CATALYSTS

[75] Inventor: Philip Varghese, Voorhees, N.J.

[73] Assignee: Mobil Oil Corporation, New York, N.Y.

[21] Appl. No.: 665,840

[22] Filed: Oct. 29, 1984

Related U.S. Application Data

[63] Continuation-in-part of Ser. No. 546,709, Oct. 28, 1983, abandoned.

[51] Int. Cl.[4] ..... C10G 45/02

[52] U.S. Cl. ..... 208/143; 208/108; 208/112; 208/213; 502/520

[58] Field of Search ..... 208/213, 108, 112, 143; 502/523, 520

[56] References Cited

U.S. PATENT DOCUMENTS

| | | | |
|---|---|---|---|
| 3,105,813 | 10/1963 | Gutberlet | 208/254 H |
| 3,131,142 | 4/1964 | Mills, Jr. | 423/53 |
| 3,161,585 | 12/1964 | Gleim et al. | 208/254 H |
| 3,331,769 | 7/1967 | Gatsis | 208/309 |
| 3,657,111 | 4/1972 | Gleim | 208/213 |
| 4,244,839 | 1/1981 | Aldridge et al. | 502/211 |
| 4,376,037 | 3/1983 | Dahlberg et al. | 208/109 |
| 4,389,301 | 6/1983 | Dahlberg et al. | 208/108 |
| 4,483,762 | 11/1984 | Grosboll | 208/108 |

*Primary Examiner*—Andrew H. Metz
*Assistant Examiner*—Anthony McFarland
*Attorney, Agent, or Firm*—Alexander J. McKillop; Michael G. Gilman; Dennis P. Santini

[57] ABSTRACT

A method to control the aging rate of catalysts useful in hydrocarbonaceous oil processing is provided, where said catalytic processing is carried out in the presence of highly dispersed or homogeneous metallic compounds or salts.

28 Claims, 3 Drawing Figures

METHOD TO DECREASE THE AGING RATE OF PETROLEUM OR LUBE PROCESSING CATALYSTS

This application is a continuation-in-part of U.S. patent application Ser. No. 546,709, filed Oct. 28, 1983 now abandoned.

FIELD OF THE INVENTION

This invention is concerned with decreasing the aging rate or extending the useful life of several conventionally used petroleum and lube processing catalysts.

BACKGROUND

A wide and increasing variety of catalysts are currently used in the refining of petroleum derived fuels and lubricants. Of these, a substantial proportion may be characterized as dual-functional in nature, comprising a hydrogenative metal component with a solid acid component. Such acids are defined as possessing Bronsted or Lewis acidity. Such dual-functional catalysts are used in the presence of hydrogen at pressures ranging from atmospheric to 10,000 psig. Examples of processes using these dual-functional catalysts include hydroreforming, hydroisomerization, hydrodewaxing and hydrocracking. In all of these, the acid function is critical to the isomerization, cracking and cyclization reactions that lead to the rearrangement of the carbon skeletons in the organic feed molecules. In fact, deactivation of the acid function by various poisons, even without a concurrent reduction in the effectiveness of the associated metal, is enough to make a catalyst ineffective for such acid catalyzed reactions.

SUMMARY OF THE INVENTION

The acidities typically required to carry out such reactions are provided by zeolites (crystalline aluminosilicates), amorphous silica-aluminas and/or their analogs containing other oxidic components. In general, the acidities encountered within this group of catalysts exceed those found on amorphous aluminas, and are greater or equal to that derived from amorphous silica-alumina. Such acidity may, for example, be conveniently defined, as is done conventionally, in terms of the hexane cracking activity of the solid acid at 1000° F. (540° C.). The elevated temperature of this definition would exclude material, such as clays, which collapse and lose their acid activity at such temperatures. Such processes may thus be clearly distinguished from others which are marginally, if at all, dependent on the presence of an active acidic function. Conventional hydrotreating, wherein the main objective is the reduction of feed sulfur and nitrogen without substantial boiling range conversion is an example of the latter and may be carried out on catalytically inactive aluminas, provided they possess the required surface area. Boiling range conversion, where it occurs over such catalysts, is brought about almost exclusively by the high thermal reactivity of the feed, usually one containing substantial residual (non-distillable) material.

The causes of aging in the acid catalyzed reactions of interest here are not clearly understood. Without restricting or limiting this application, the following reasoning is presented concerning aging in acid catalyzed reactions.

In general, it is believed that two mechanisms of deactivation are operative. Coke deposition, with consequent blockage of catalytic sites, is considered to be one mode of deactivation. This deactivating coke is thought to result from so-called "asphaltenic" species present in the feed, which degenerate thermally into coke. Such processes take place at high temperatures (greater than 450° C.) and with feed containing high levels of CCR (Conradson Carbon Residue) and heptane insoluble asphaltenes. For many conventional uses of acid catalysis, such as reforming, hydrocracking, hydrowaxing and hydroisomerization, the conventional feeds are substantially asphaltene and CCR-free (less than 0.1 wt %), and process conditions are often substantially milder than those at which purely thermally generated coke is formed. Consequently, the source and mechanism of formation of coke on acid catalysts is not well understood. It has, in fact, been difficult even to precisely estimate the contribution of such coke formation to the decline of catalyst acidity.

For the majority of acid catalyzed reactions, the principal route to catalyst deactivation has been hitherto presumed to be a combination of (a) the poisoning of acid sites by basic species in the feed, that is, basic nitrogen compounds, and (b) the acid catalyzed formation of high molecular weight site blocking species.

Studies directed at understanding the nature and contribution of thermal reactions to the latter led to unexpected results, which, in turn, lead to this invention. Specifically, it can be found that, for a wide variety of feeds ranging in chemical type from highly paraffinic to highly aromatic liquids of a boiling range from 200° to 500° C., and even higher boiling residual liquids, it is observed that a purely thermal generation of carbon centered free radical species is possible at temperatures as low as 300° C. The evidence now available shows that the concentration of these reactive free radical species appears to be responsible for the formation, via acid catalyzed reactions, of regression products on catalyst surfaces that cause pronounced deactivation of the acid function. As shown in Example 1, the same types of reactive free radical species are implicated in the production of coke by purely thermal means, for feeds, such as resids, that contain high levels of asphaltenes and CCR. It is emphasized that the presence of measurable (greater than 0.1 wt %) asphaltenes and/or CCR in the feed is not a prerequisite for the formation of free radical intermediates, even though the generation of thermal coke appears to require such feed characteristics.

In addition to the unexpectedly low temperatures at which these free radical reactive intermediates are formed, it is also found that use of a highly dispersed metallic hydrogenation in low loadings can, by supplying small but significant quantities of hydrogen to these free-radical species, stabilize and prevent them from forming higher molecular weight species that are presumed harmful to acid catalysts. This favorable effect requires the presence of the dispersed metal agent under hydrogen in the feed prior to it being subjected to temperatures, even as high as 300° C. These temperatures were previously considered innocuous in the industry.

It is also observed, by way of an unexpected synergism in catalytic performance when a conventional hydrocracking catalyst is combined with such feed doped dispersed metal, that the free radical species are, by mechanisms as yet unclear, further acted upon by strong solid acids to lead to deactivating species. Thus, it would appear that by reducing the concentration of reactive free radical intermediates, present during conventional acid-catalyzed processes, unexpectedly large benefits are observed in acid catalyst performance. It should be noted that in the absence of the acid catalyst, purely thermal treatment of many feeds of interest here would not lead to measurable thermal coke formation. Thus, the coke is presumably formed here by thermal plus acid-catalytic reaction and not by thermal reaction alone.

In general, the method for sustaining the activity of the subject solid acid catalysts comprises premixing a small quantity of a highly dispersed, near or substantially homogeneous, metallic component with the feedstock in an otherwise conventional catalytic conversion in a fixed, a fluid or an ebullated bed reactor. The metal is preferably one having good hydrogenation activity. Examples of suitable metals include Mo, Fe, Ni, Pt, Pd, etc., and other transition and noble metals known in the art to possess the desired type of activity, such as the transition and noble metals listed in the Periodic Table of Elements. A combination of these metals can also be used. Of special interest are metals from Group VI or VIII of the Periodic Table of Elements.

The quantity of metal employed need not exceed 2000 ppm by weight of feed, provided high dispersion is assured. Preferably, the quantity of metal employed should be about 10 to about 300 ppm. High dispersion or homogenization may be assured by introducing the metal as an initially soluble entity, preferably in the feed prior to the acid catalyzed reaction. This may involve an oil-soluble organometallic compound, such as molybdenum naphthenate, or other procedures known in the art to adequately emulsify and disperse a water-soluble metal salt.

The process may be summarized as follows: (1) a small quantity of a suitable metal is premixed with the base feedstock for a conventional process, (2) the metal is mixed in any convenient manner known in the art, ensuring high dispersion thereof within the feedstock, (3) the feedstock is then processed in a conventional manner in the acid catalyzed process, and (4) the dispersed metal is optionally recovered. It is important that the dispersed metal decompose or attain its active form under hydrogen pressure and before the reaction mixture exceeds a temperature of 300° C. Thus, the dispersed metal is preferably premixed with feedstock prior to any acid catalyzed reaction. Any dispersed metal in the liquid product may need to be recovered for certain uss, but, in many instances, the product may not be harmed by the presence of these metals at a level of parts per million.

The acid catalyzed dual reaction can occur at temperatures of about 300° to about 450° C. and pressures of hydrogen from about 100 to about 1750 psig.

In some instances, the co-fed metal catalyst will deposit on the conventional acid catalyst, resulting in enhancement of its hydrogenation activity. However, this slight enhancement in hydrogenation ability is not the object of this invention, and the more important benefit is a demonstrable and substantial increase in the efficiency of the primary acid catalyst. Occasionally, depending on reactor type and feed, the co-fed metal may exit, with reaction products deposited on fine carbonaceous particles. Separation of such metals from the product is preferably achieved by the use of filters or hydrocyclones. If the resultant removed metal has a high enough dispersion, it may even be recycled, that is, co-fed again with fresh feed.

It has now been found that an excellent way of controlling thermal side reactions that cause deactivation of conventional acid catalysts is to employ a very highly dispersed, or substantially homogeneous, metallic hydrogenation agent, such as Mo, Pt, Ni, etc., in admixture with feedstock to a conventional acid catalytic reaction. Although applicant does not wish to be held to any theory, these dispersed hydrogenating agents appear to be able to reduce the concentration of thermally generated reactive intermediates by effectively stabilizing them. The reduced concentration of free radicals results in the slower formation of regressive coke on catalyst from the subsequent acid catalyzed reaction of free radicals. Their effectiveness on a weight basis is proportional to the degree of dispersion initially obtained, most likely because the thermal side reactions that generate coke precursors are homogeneous within the bulk reactant phase. The metals can be initially dispersed by suitable choice of an oil-soluble metal compound or salt or by the use of suitable procedures to adequately emulsify and disperse such water-soluble metal salts. Other means of achieving the high degree of dispersion desired of the hydrogenating metal are, of course, known in the art and may be used.

The invention is directed to a two-catalyst system comprising a first acid catalyst or dual functional catalyst to promote a desired process result, and a second catalyst to substantially reduce the aging rate and/or increase activity of the first or process catalyst.

The invention relates to a process for decreasing aging rate and concommitantly increasing activity and effective life of a heterogeneous solid acid catalyst, suitable for use in conventional hydrocarbon feedstock upgrading processes, comprising (a) premixing an effective proportion of a hydrogenation metal catalyst selected from among transition or noble metals with a feedstock, in a manner whereby the transition or noble metal is highly dispersed therein; and (b) upgrading the feedstock in the presence of the dispersed metal catalyst over a heterogeneous solid acid catalyst, whereby the aging rate of the heterogeneous solid acid catalyst is decreased and its useful life significantly extended.

The invention also relates to an improvement in a hydrogenation process, comprising a two-catalyst system wherein the feed thereto being subject to an acid catalyzed reaction at temperatures of about 300° to about 450° C. and hydrogen partial pressures from about 100 to about 1750 psig, and simultaneously being subjected to treatment by a second highly dispersed substantially homogeneous metallic catalyst intimately admixed with the feed prior to the acid catalyst, wherein the aging rate of the acid catalyst is decreased and its useful life significantly extended.

This invention relates to a process for decreasing aging rate and concommitantly increasing activity and effective life of a heterogeneous solid acid catalyst suitable for use in conventional hydrocarbon oil feedstock upgrading processes comprising: (a) premixing an effective proportion of a soluble hydrogenation metal catalyst selected from among transition or noble metal compounds, with an oil feedstock, in a manner whereby the transition or noble metal compound is highly dispersed therein and reduces concentration of reactive free radical intermediates thermally generated in the oil feedstock; and (b) upgrading the feedstock in the presence of the dispersed metal catalyst over a heterogeneous solid acid catalyst having a hexane cracking activity at 540° C. that exceeds or equals the activity of amorphous silica-alumina, whereby the metal compound decomposes to an active form of the metal catalyst and the aging rate of the heterogeneous solid acid catalyst is decreased and its useful life significantly extended.

Features of the present invention will be described in connection with the accompanying drawings.

DESCRIPTION OF EMBODIMENTS

Any conventional catalyst useful in the acid catalyzed processing of hydrocarbonaceous fuel or lube stocks can have its useful life extended by utilization of the method disclosed herein for decreasing the aging rate of such catalysts. These catalysts include, but are not limited, to those known in the art as being useful in hydrogenation processes, such as hydrocracking, hydrotreating, hydroisomerization, hydrodewaxing, etc., as well as hydroreforming. It is, therefore, to be understood that lube or petroleum processing includes hydrocracking, hydrotreating, hydroisomerization, hydrodewaxing and the like. Accordingly, a feedstock can be any 200° C.+ oil and can contain greater than 10 wt % of 600° C.+ material.

The catalysts whose useful life can be extended by this method include solid acids, such as zeolites (crystalline alumino silicates), amorphous silica-alumina, crystalline silica-alumino phosphates, and other such catalysts having metal dispersed therein or impregnated thereon to provide dual functionality.

The method disclosed herein is especially significant in extending the lifetime of catalysts in processing liquids boiling above 200° C., as in gas oil conversion, resid conversion, bright stock dewaxing, whole crude conversion, and the like.

Understanding of this invention will be facilitated by reference to the following examples, in which parts and percentages are by weight, unless expressly stated to be on some other basis. These examples are illustrative only and in no way limiting upon the scope of this invention.

EXAMPLE 1

The following example demonstrates the effectiveness of even minor quantitites of well dispersed hydrogenation metal in reducing the concentration of thermally generated free radical species. This process, as shown, is capable of reducing even the purly thermal coke produced in such processes.

Figure 1:
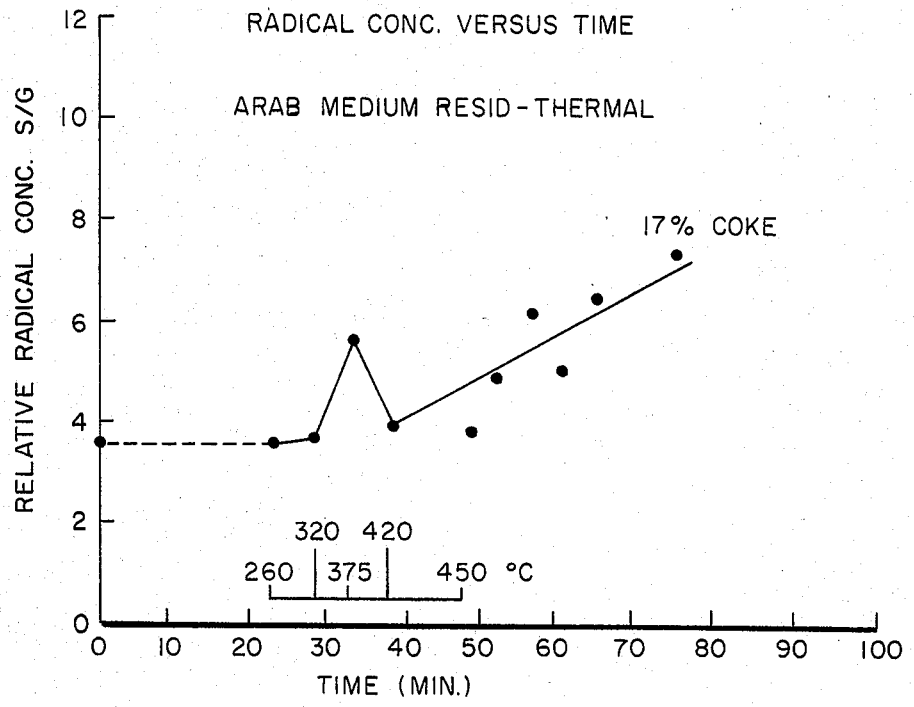
FIG. 1 is a plot of free-radical concentration versus time of a conventional catalytic feedstock.

A vacuum residue from an Arab medium crude oil was charged to an autoclave and heated to 450° C. under 1600 psig $H_2$ pressure. It is held for a period of 40 minutes at 450° C. Samples are periodically withdrawn from the autoclave for analysis. Electron spin resonance spectroscopy is employed to measure the free radical concentration as a function of time. FIG. 1 shows free radical concentration as spins/gram for this example. The figure also shows the eventual coke yield of 17 wt % (of the resid) that resulted from uncontrolled thermal reactions.

It is important to note that the generation of free radical intermediates is evident at temperatures as low as 320° C., well below previously known susceptibility to thermal reactions in such feeds. It is also shown that there is a circumstantial link between the time-averaged free radical concentration during reaction and the thermal coke made. A similar, but much more unexpected and more significant correlation between the concentration of such thermally generated species and acid catalyzed reactions is shown by another of the examples.

Figure 2:
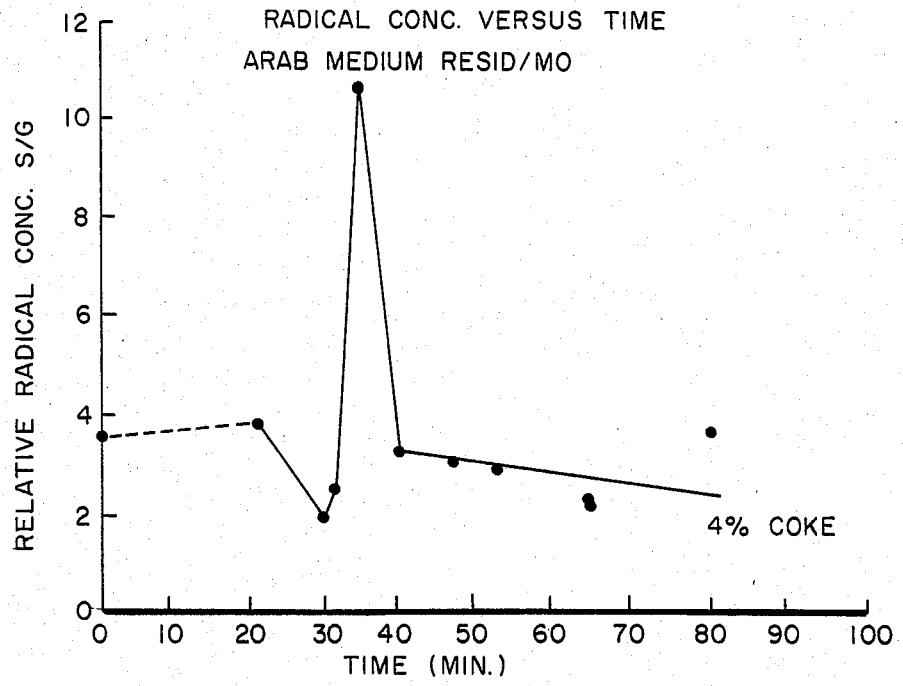
FIG. 2 is a plot of free-radical concentration versus time of a catalytic feedstock having minor amounts of suitable metal dispersed therein.

Addition of 360 ppm of molybdenum as an initially oil-soluble naphthenate, to an otherwise identical crude oil residue, as per above, results in highly significant and sharp reduction of free radical concentration. This is shown in FIG. 2. The presence of the dispersed metal clearly reduces the time integrated concentration of free radicals during the reaction period. As a probable direct result of the presence of the metal, the amount of thermally generated coke is reduced from 17 to 4 wt %, a reduction of more than 75%.

EXAMPLE 2

The following example is derived from the hydroprocessing of a low CCR-non-asphaltenic oil derived from Paraho shale over a dual functional catalyst. The catalyst is a zeolite based acid catalyst containing 8 wt % impregnated molybdenum. An accelerated aging process is employed under the following conditions: 800° F., 1400 psig hydrogen pressure, and liquid hourly space velocity of 4. Under these conditions, no measurable coke would be formed purely thermally, but free radical intermediates, which could react under strong acid-catalysis to form coke, are nevertheless present.

Figure 3:
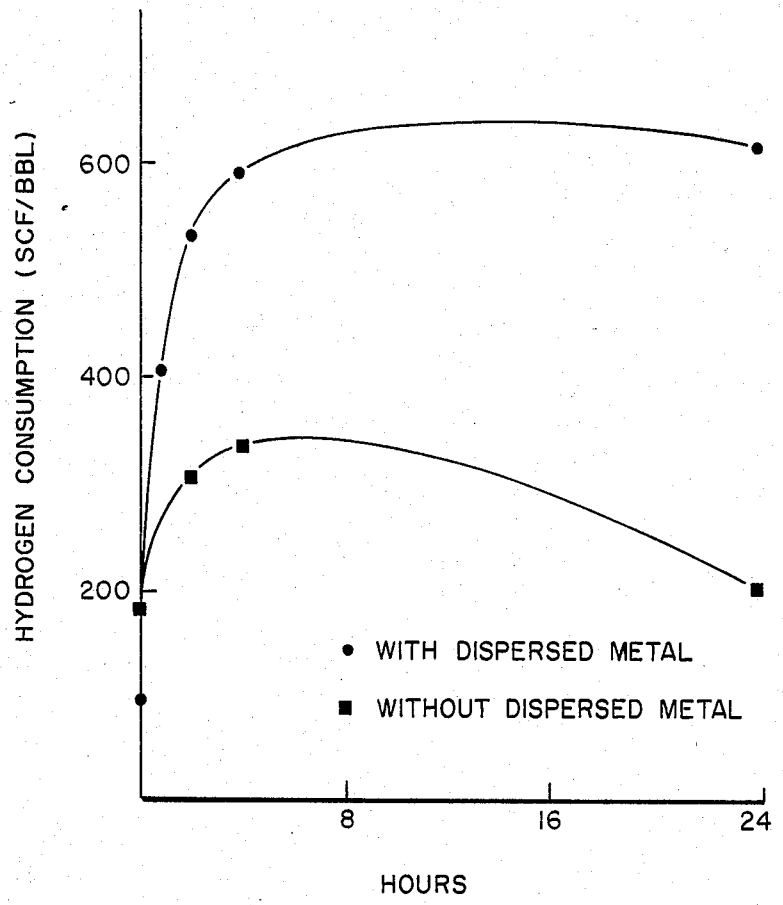
FIG. 3 depicts the increased hydrogen consumption when the dispersed metal is added to the feedstock.

The activity of the conventional catalyst is compared in a fixed bed reactor, both with and without dispersed metal. In the first case, 180 ppm of molybdenum metal is added and is dispersed in the feed. In the second case, the feed did not contain dispersed metal. The performance of the conventional catalyst is decidedly superior in the first instance, that is, when the feed contains highly dispersed, substantially homogeneous metal. The hydrogen uptake by the product, which in this case is primarily (greater than 90%) attributable to acid catalyzed hydrocracking, is one measure of this performance. FIG. 3 shows that the hydrogen consumed by the conversion, having 180 ppm molybdenum in the feed, is significantly higher than that consumed when the metallic component or second catalyst is employed. With increased time on stream, the advantage over conventional operation increases.

The large difference observed is not attributable to the purely hydrogenating function of the added dispersed metal, because, in a separate experiment, the metal above, when added to the feed as the only catalyst under the same physical conditions, consumed only a constant 80–90 scf/bbl. The great impact on hydrocracking derived hydrogen consumption must be attributed to an unexpected synergism between the action of the dispersed metal and the primary process catalyst—the acid zeolite.

EXAMPLE 3

High temperature hydrocracking of Arab light vacuum residue over a pelleted Co-Mo/silica-alumina catalyst at 840° F., with 100–200 ppm molybdenum in the feed, provides the following benefits over processing such residua without the metal co-feed:

(a) The activity decline for hydrocracking and hydrodesulfurization is arrested by in-situ deposition of additional catalytically active metals on the pelleted catalyst by decomposition of the dispersed molybdenum compound.

(b) Coke formation on the catalyst by thermally generated precursors is reduced and the rate of loss in acid activity of the supported catalyst is decreased.

The above examples illustrate that highly dispersed metals in low concentrations can effectively provide prolonged activity for conventional solid acid catalysts in many applications.

Although the present invention has been described with preferred embodiments, it is to be understood that modifications and variations may be resorted to, without departing from the spirit and scope of this invention, as those skilled in the art will readily understand. For example, the upgrading process can take place in a fluid, fixed or an ebulated bed reactor. Such modifications and variations are considered to be within the purview and scope of the appended claims.

I claim:

1. A process for decreasing aging rate and concommitantly increasing activity and effective life of a heterogeneous solid acid catalyst comprising:

(a) premixing an effective proportion of a hydrogenation metal catalyst selected from among transition or noble metals, with a substantially asphaltene-free feedstock having an asphaltene concentration of less than 0.1 weight percent in a manner whereby the transition or noble metal is highly dispersed therein; and (b) upgrading the feedstock in the presence of the dispersed metal catalyst over a heterogeneous solid acid catalyst in presence of hydrogen, whereby the aging rate of the heterogeneous solid acid catalyst is decreased and its useful life significantly extended.

2. The process according to claim 1, wherein the metal is a transition metal or a noble metal, or combinations thereof.

3. The process according to claim 2, wherein the metal is Mo, Fe, Ni, Pt or Pd.

4. The process according to claim 2, wherein the metal is from Group VI or VIII of the Periodic Table of Elements.

5. The process according to claim 1, wherein the metal is dispersed in the feedstock in an amount from about 10 to about 360 ppm.

6. The process according to claim 1, wherein the metal prior to being dispersed is an oil-soluble metal compound or salt.

7. The process according to claim 1, wherein the feedstock is an oil that has not previously experienced process temperatures exceeding 300° C.

8. The process according to claim 7, wherein the metal is introduced as an oil soluble compound that decomposes to an active form of the metal at temperatures below 300° C.

9. The process according to claim 1, wherein the metal is dispersed by emulsifying a water-soluble metal compound or salt.

10. The process according to claim 1, wherein the oil is a 400° C.+ residual oil containing at least 10 wt % of 600° C.+ material.

11. The process according to claim 1, wherein the primary acid catalyst is a catalyst suitable for use in hydrogenation processes.

12. The process according to claim 1, wherein the dispersed metal is recovered and partially recycled.

13. The method according to claim 1, wherein said upgrading process takes place in a fluid bed reactor.

14. The process according to claim 1, wherein the upgrading process takes place in a fixed or ebullated bed reactor.

15. The process according to claim 1, wherein the hydrogenation metal catalyst reduces the concentration of reactive free radical intermediates generated in the feedstock.

16. The process according to claim 15, wherein the reactive free radical intermediate is formed by thermal processes.

17. The process according to claim 1, wherein the heterogeneous solid acid catalyst is a zeolite catalyst or an amorphous silica-alumina catalyst.

18. The process according to claim 17, wherein the heterogeneous solid acid catalyst has a hexane cracking activity at 540° C. that exceeds or equals the activity of amorphous silica-alumina.

19. The process according to claim 1, wherein the feedstock is Arab medium crude oil, Arab light vacuum residue or Paraho shale derived distillate oil.

20. In a hydrogenation process, the improvement comprising employing a two-catalyst system wherein the substantially asphaltene feed thereto having an asphaltene concentration of less than 0.1 weight percent being subject to an acid catalyzed reaction at temperatures of about 300° to about 450° C. and hydrogen partial pressures from about 100 to about 1750 psig, and simultaneously being subjected to treatment by a second highly dispersed, substantially homogeneous metallic catalyst intimately admixed with the feed prior to the acid catalyzed reaction, whereby the aging rate of the acid catalyst is decreased and its useful life significantly extended.

21. The process according to claim 20, wherein the hydrogenation process takes place in a fixed, fluid or ebullated bed reactor.

22. The process according to claim 20, wherein the acid catalyst is a zeolite catalyst or an amorphous silica-alumina catalyst.

23. The process according to claim 22, wherein the acid catalyst has a hexane cracking activity at 540° C. that exceeds or equals the activity of amorphous silica-alumina.

24. The process according to claim 20, wherein the metal catalyst reduces the concentration of reactive free radical intermediates generated in the feed.

25. The process according to claim 20, wherein the reactive free radical intermediate is formed during thermal processes.

26. The process according to claim 20, wherein the feedstock is Arab medium crude oil, Arab light vacuum residue or Paraho shale derived distillate oil.

27. A process for decreasing aging rate and concommitantly increasing activity and effective life of a heterogeneous solid acid catalyst comprising:

(a) premixing an effective proportion of a soluble hydrogenation metal catalyst selected from among transition or noble metal compounds, substantially asphaltene-free oil feedstock having an asphaltene concentration of less than 0.1 weight percent, in a manner whereby the transition or noble metal compound is highly dispersed therein and reduces concentration of reactive free radical intermediates thermally generated in the oil feedstock; and (b) upgrading the feedstock in the presence of the dispersed metal catalyst over a heterogeneous solid acid catalyst, having a hexane cracking activity at 540 C that exceeds or equals the activity of amorphous silica-alumina, in the presence of hydrogen, whereby the metal compound decomposes to an active form of the metal catalyst and the aging rate of the heterogeneous solid acid catalyst is decreased and its useful life significantly extended.

28. The process according to claim 27, wherein the feedstock is Arab medium crude oil, Arab light vacuum residue or Paraho shale derived distillate oil.

* * * * *

UNITED STATES PATENT AND TRADEMARK OFFICE

CERTIFICATE OF CORRECTION

PATENT NO. : 4,581,127

DATED : April 8, 1986

INVENTOR(S) : Philip Varghese

It is certified that error appears in the above-identified patent and that said Letters Patent is hereby corrected as shown below:

Col. 3, line 26, add -- from -- after "should be"

line 48, "uss" should be -- uses --

Col. 8, claim 20, line 27, insert -- -free -- after "asphaltene"

Signed and Sealed this

Fourteenth Day of April, 1987

*Attest:*

DONALD J. QUIGG

*Attesting Officer*

*Commissioner of Patents and Trademarks*